US010330066B2

(12) United States Patent
Kulzer

(10) Patent No.: US 10,330,066 B2
(45) Date of Patent: Jun. 25, 2019

(54) HIGH-PRESSURE FUEL PUMP

(71) Applicant: Continental Automotive GmbH, Hannover (DE)

(72) Inventor: Stefan Kulzer, Beucherling (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 15/127,495

(22) PCT Filed: Oct. 7, 2015

(86) PCT No.: PCT/EP2015/073137

§ 371 (c)(1),
(2) Date: Sep. 20, 2016

(87) PCT Pub. No.: WO2016/058886

PCT Pub. Date: Apr. 21, 2016

(65) Prior Publication Data

US 2018/0171952 A1 Jun. 21, 2018

(30) Foreign Application Priority Data

Oct. 15, 2014 (DE) ..... 10 2014 220 878

(51) Int. Cl.
*F02M 59/48* (2006.01)
*F02M 55/00* (2006.01)
(Continued)

(52) U.S. Cl.
CPC ..... *F02M 59/485* (2013.01); *F02M 55/005* (2013.01); *F02M 59/102* (2013.01);
(Continued)

(58) Field of Classification Search
CPC ..... F02M 59/485; F02M 59/48
See application file for complete search history.

(56) References Cited

U.S. PATENT DOCUMENTS 5,071,324 A * 12/1991 Ishimoto ..... F02M 59/445 123/495
8,672,652 B2 * 3/2014 Munakata ..... B23K 11/16 417/437
(Continued)

FOREIGN PATENT DOCUMENTS

DE 10322595 A1 12/2004 ..... F02M 59/44
DE 102007051584 A1 4/2009 ..... F02M 61/16
(Continued)

OTHER PUBLICATIONS

German Office Action, Application No. 102014220878.5, 4 pages, dated Oct. 5, 2015.
(Continued)

*Primary Examiner* — Thomas E Lazo
(74) *Attorney, Agent, or Firm* — Slayden Grubert Beard PLLC

(57) ABSTRACT

The present disclosure relates to high-pressure fuel pumps and the teaching may be applied to pumps in which a pump piston, by means of which a fuel is acted on with a high pressure, is guided in a guiding sleeve. In some embodiments, a high-pressure fuel pump may include: a housing having a housing recess; a pump piston for pressurizing a fuel; and a guiding sleeve arranged in the housing recess and guiding the pump piston. The guiding sleeve is connected to the housing recess with a materially engaging connection.

6 Claims, 3 Drawing Sheets

(51) Int. Cl.
*F02M 59/10* (2006.01)
*F02M 59/26* (2006.01)
*F02M 59/36* (2006.01)

(52) U.S. Cl.
CPC ..... *F02M 59/26* (2013.01); *F02M 59/36* (2013.01); *F02M 2200/8038* (2013.01); *F02M 2200/8053* (2013.01); *F02M 2200/8084* (2013.01)

(56) References Cited

U.S. PATENT DOCUMENTS

| | | | | |
|---|---|---|---|---|
| 9,115,713 | B2 * | 8/2015 | Oikawa | F02M 59/44 |
| 2004/0052664 | A1 * | 3/2004 | Saito | F02M 59/366 417/490 |
| 2009/0110575 | A1 * | 4/2009 | Munakata | B23K 11/16 417/437 |
| 2012/0251363 | A1 * | 10/2012 | Kuroyanagi | F02M 59/102 417/437 |
| 2015/0300338 | A1 | 10/2015 | Aritomi et al. | 92/169.1 |

FOREIGN PATENT DOCUMENTS

| | | | | |
|---|---|---|---|---|
| DE | 102007055256 | A1 | 5/2009 | F02M 59/02 |
| DE | 10322603 | B4 | 4/2013 | F02M 55/00 |
| DE | 102013201453 | A1 | 8/2014 | F02M 61/18 |
| EP | 2055934 | A2 | 5/2009 | B23K 33/00 |
| JP | 2004052664 | A | 2/2004 | F02M 37/08 |
| JP | 2006161817 | A | 6/2006 | F02M 59/44 |
| JP | 2010037985 | A | 2/2010 | F02M 59/10 |
| JP | 2011231758 | A | 11/2011 | F02M 59/44 |
| JP | 2014088838 | A | 5/2014 | F02M 59/26 |
| WO | 2016/058886 | A1 | 4/2016 | F02M 59/48 |

OTHER PUBLICATIONS

International Search Report and Written Opinion, Application No. PCT/EP2015/073137, 12 pages, dated Feb. 2, 2016.
Japanese Office Action, Application No. 2016560479, 3 pages, dated Oct. 2, 2017.
Korean Office Action, Application No. 2018004864085, 12 pages, dated Jan. 19, 2018.
Japanese Office Action, Application No. 2016560479, 4 pages, dated May 14, 2018.

* cited by examiner

HIGH-PRESSURE FUEL PUMP

CROSS-REFERENCE TO RELATED APPLICATIONS

This application is a U.S. National Stage Application of International Application No. PCT/EP2015/073137 filed Oct. 7, 2015, which designates the United States of America, and claims priority to DE Application No. 10 2014 220 878.5 filed Oct. 15, 2014, the contents of which are hereby incorporated by reference in their entirety.

TECHNICAL FIELD

The present disclosure relates to high-pressure fuel pumps and the teaching may be applied to pumps in which a pump piston, by means of which a fuel is acted on with a high pressure, is guided in a guiding sleeve.

BACKGROUND

High-pressure fuel pumps are often used for fuel injection systems for internal combustion engines. They exert high pressure on a fuel to be supplied to a combustion chamber of the internal combustion engine and are mostly constructed as piston pumps. In such pumps, a pump piston compresses the fuel located in a pressure chamber by means of a translational back and forth movement and consequently produces a high pressure in the fuel. For example, with high-pressure fuel pumps for petrol internal combustion engines, the fuel is acted on with a pressure of from 200 bar-300 bar whilst the fuel for diesel internal combustion engines is acted on with a pressure of from 2000 bar-3000 bar.

As a result of the high pressures, it is advantageous from a tribological viewpoint to provide a wear-resistant configuration of a piston guide in which the pump piston is guided. To this end, for example, it is known to use a specially constructed guiding sleeve for the pump piston. Such a high-pressure fuel pump is known, for example, from DE 103 22 603 B4.

A positive-locking connection is achieved therein between a guiding sleeve for the pump piston and a housing of the high-pressure fuel pump by pressing in the guiding sleeve and caulking a collar to the housing.

However, this type of positive-locking connection involves high necessary assembly forces of several kN and produces tensions in the components, which may lead to deformations of these components. In this instance, deformations, for example, of valve seats of the high-pressure fuel pump or the guide of the pump piston itself are considered to be particularly critical since they can lead to internal leakage paths and consequently in the worst case to loss of the function of the high-pressure fuel pump.

In addition, during operation of the high-pressure fuel pump, as a result of the operating conditions such as temperature, oscillations, etcetera, a settling behavior of the positive-locking connection may take place at the caulking of the guiding sleeve and a leakage path from a pressure chamber of the high-pressure fuel pump via the outer diameter of the guiding sleeve may thereby occur again since the required pretensioning of the guiding sleeve at the side which is directed toward the pressure chamber is no longer ensured.

SUMMARY

The teachings of the present disclosure may provide a high-pressure fuel pump which overcomes the problems mentioned.

Some embodiments may include a high-pressure fuel pump (10) having: a housing (12) having a housing recess (14), and a guiding sleeve (18) which is arranged in the housing recess (14) for guiding a pump piston (16) of the high-pressure fuel pump (10). The guiding sleeve (18) is connected to the housing recess (14) by means of a materially engaging connection (38).

In some embodiments, the materially engaging connection (38) has an adhesive connection (41) which comprises an adhesive (40).

In some embodiments, the adhesive (40) is thermally stable up to a temperature of at least 180° C.

In some embodiments, the adhesive (40) is insoluble in fuels (26), in particular in petrol and/or diesel.

In some embodiments, the guiding sleeve (18) is arranged in an offset (20) of the housing recess (14) which extends adjacent to a pressure chamber (22) of the high-pressure fuel pump (10) as far as a chamber (34) at an end of the pump piston (16) opposite the pressure chamber (22), wherein the offset (20) has an offset end face (46) on which a guiding sleeve end face (48) of the guiding sleeve (18) is arranged, wherein the adhesive (40) is arranged between the offset end face (46) and the guiding sleeve end face (48).

In some embodiments, the offset (20) has an offset side face (52) on which a guiding sleeve side face (54) is arranged, wherein the adhesive (40) is arranged between the offset side face (52) and the guiding sleeve side face (54).

In some embodiments, the materially engaging connection (38) has a weld connection (42), in particular a friction weld connection.

In some embodiments, the materially engaging connection (38) has a region in which the guiding sleeve (18) is vulcanized to the housing recess (14).

In some embodiments, a sealing arrangement (50) is provided between the housing recess (14) and the guiding sleeve (18).

In some embodiments, the guiding sleeve (18) is formed from a material which has a greater hardness than the material of the housing (12).

BRIEF DESCRIPTION OF THE DRAWINGS

The teachings of the present disclosure are explained in greater detail below with reference to the appended drawings, in which.

DETAILED DESCRIPTION

Figure 1:
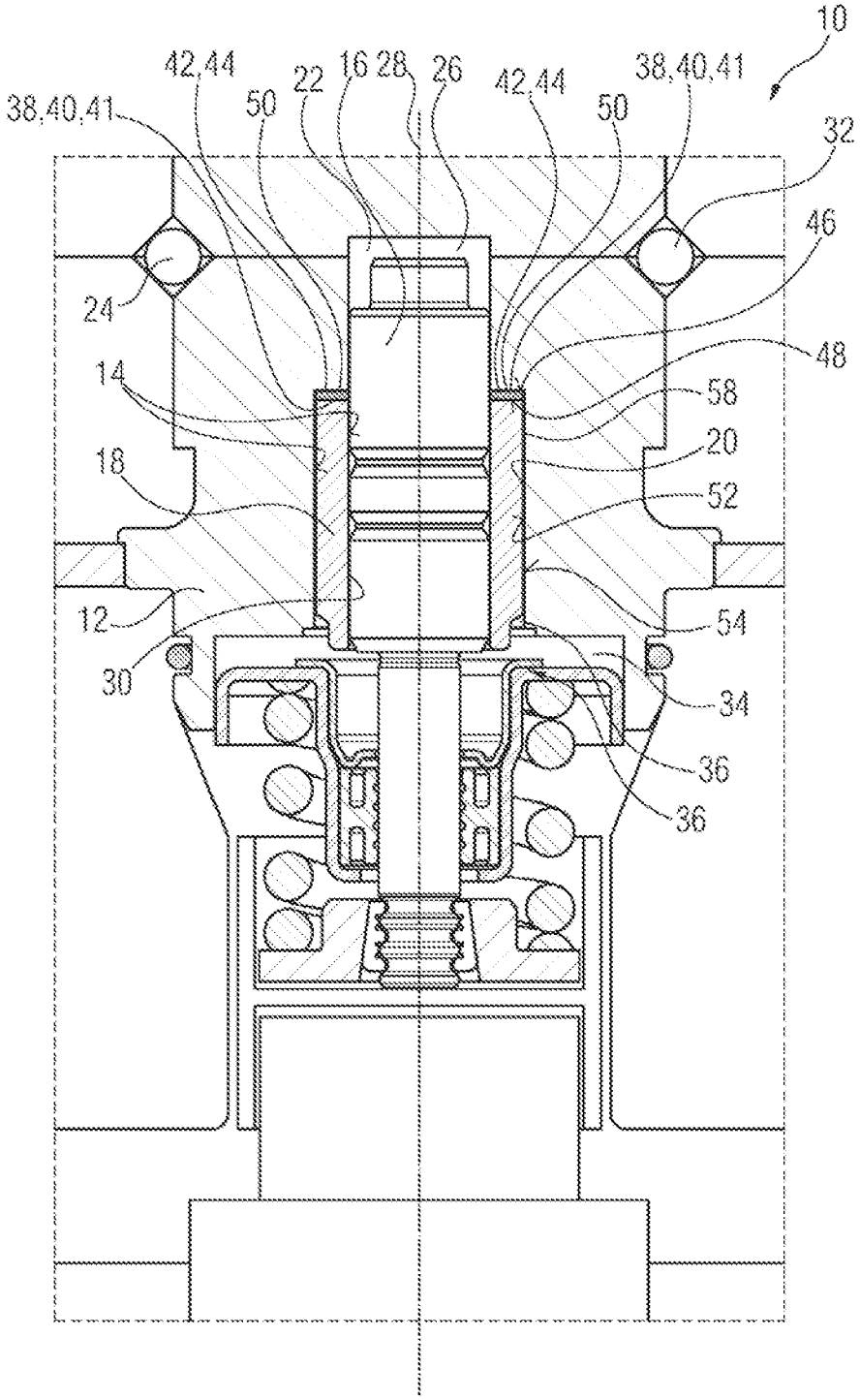
FIG. 1 is a longitudinally sectioned view of a first embodiment of a high-pressure fuel pump with a materially engaging connection between a guiding sleeve and a housing recess.

In some embodiments, a high-pressure fuel pump has a housing having a housing recess and a guiding sleeve which is arranged in the housing recess for guiding a pump piston of the high-pressure fuel pump. The guiding sleeve is connected to the housing recess by means of a materially engaging connection.

In place of the positive-locking connection, therefore, the pump may include a materially engaging connection of the components housing and guiding sleeve of the high-pressure fuel pump. Tensions and deformations in these components can thereby be prevented, which leads to a reduction of defects in the high-pressure fuel pump. Some embodiments may include a guiding gap between the guiding sleeve and the pump piston which is guided therein which during operation is filled with a fuel in order to thus act as a lubricant during the movement of the pump piston in the guiding sleeve.

In some embodiments, the materially engaging connection has an adhesive connection which comprises an adhesive. Adhesives may be fitted in the housing recess or to the guiding sleeve in a simple manner so that the guiding sleeve can be connected to the housing by means of a particularly simple method. The adhesive may be thermally stable up to a temperature of at least 180° C.

During operation of the high-pressure fuel pump peak temperatures between 150° C. and 180° C. may occur. Embodiments with an adhesive that does not soften in this temperature range may improve the performance of the connection between the housing and guiding sleeve and reduce the chance it might become disengaged. In some embodiments, the adhesive may be thermally stable and not soften up to a temperature of at least 180° C.

In some embodiments, the adhesive may be insoluble in fuels, in particular in petrol and/or diesel. If the adhesive does not dissolve as a result of contact with fuel, the connection between the housing and guiding sleeve may not become disengaged.

For example, the adhesive may be based on water glass and/or cement and/or polyurethane. Adhesives based on these materials which have a high temperature-resistance and insolubility in fuels, which is advantageous for the above-mentioned reasons, are commercially available. The guiding sleeve may be arranged in an offset of the housing recess which extends adjacent to a pressure chamber of the high-pressure fuel pump as far as a chamber at the other end of the pump piston. In this instance, the offset may have an offset end face on which a guiding sleeve end face of the guiding sleeve is arranged, wherein the adhesive is arranged between the offset end face and the guiding sleeve end face.

Such embodiment may provide sealing of a joint between the housing recess and guiding sleeve toward the pressure chamber automatically. A fuel leak in the joint between the housing recess and guiding sleeve can thereby be avoided.

In some embodiments, the offset has an offset side face on which a guiding sleeve side face is arranged, wherein the adhesive is arranged between the offset side face and the guiding sleeve side face. If the adhesive is arranged not only in the region of the end faces, but instead also in the region of the side faces, an improved sealing of the joint with respect to a fuel leakage may be produced.

Alternatively or additionally, the materially engaging connection may have a weld connection. For example the weld connection may be a friction weld connection, that is to say, a weld connection in which the guiding sleeve has been connected by means of advantageous rubbing-together of a guiding sleeve surface and a housing recess wall with the housing recess.

Weld connections may be particularly secure and sealed against a fuel leakage. Alternatively or additionally, the materially engaging connection may also have a region in which the guiding sleeve is vulcanized to the housing recess.

Some embodiments may include a sealing arrangement between the housing recess and the guiding sleeve. An additional sealing arrangement may prevent, together with the materially engaging connection, the introduction of fuel leakage into the joint between the housing recess and guiding sleeve.

In some embodiments, the guiding sleeve is formed from a material which has a greater hardness than the material of the housing. It is thereby possible to achieve a wear-resistant construction of the pairing pump piston/guiding sleeve. At the same time, the high-pressure fuel pump can be constructed in a more cost-effective manner since only the region which is subjected to wear as a result of movement of the pump piston, that is to say, the guiding sleeve, is formed from the higher-quality material whilst the housing is formed from a standard material which is more cost-effective. For example, the guiding sleeve may be constructed from a hardened high-grade steel, whilst the housing is formed from a normal high-grade steel.

In some embodiments, in which the materially engaging connection has a weld connection or a vulcanized region, these regions may also be located on the respective end faces of the offset and guiding sleeve in order in this instance to lead to a sealing action of the materially engaging connection directly in the region of the pressure chamber.

Improved sealing of the connection can be further achieved when this type of materially engaging connection—weld connection or vulcanization—is also arranged in regions of the side faces of the guiding sleeve and offset.

It is further also possible in this instance to arrange a sealing arrangement between the housing recess and guiding sleeve.

FIG. 1 is a longitudinally sectioned view of a high-pressure fuel pump 10 which has a housing 12 with a housing recess 14 in which a pump piston 16 and a guiding sleeve 18 are arranged in order to guide the pump piston 16.

The guiding sleeve 18 is formed from a harder material than the housing 12 so that, in the region of the pairing pump piston 16/guiding sleeve 18, a wear-resistant construction of the high-pressure fuel pump 10 can be achieved.

The housing recess 14 has an offset 20 in which the guiding sleeve 18 is arranged. In an upper region of the housing recess 14, there is formed a pressure chamber 22 in which a fuel 26 can be introduced via a valve 24.

The pump piston 16 is movably guided along a longitudinal axis 28 in the guiding sleeve 18. In this instance, there is formed between the guiding sleeve 18 and pump piston 16 a guiding gap 30 which is filled during operation with the fuel 26 as a lubricant so that the guiding sleeve 18 is arranged in the housing recess 14 in a force-free manner during operation.

As a result of the translational movement of the pump piston 16 along the longitudinal axis 28, the fuel 26 located in the pressure chamber 22 is compressed and acted on with high pressure. The fuel 26 acted on with pressure is then discharged from the pressure chamber 22 via an additional valve 32 and is supplied to a combustion chamber (not shown) of an internal combustion engine.

The offset 20 opens opposite the pressure chamber 22 relative to a chamber 34 at the lower end of the pump piston 16.

The guiding sleeve 18 is secured in the offset 20 by means of a materially engaging connection 38.

The materially engaging connection 38 may in this instance be formed by an adhesive 40 and may consequently form an adhesive connection 41, but it may also be a weld connection 42, such as, for example, a friction weld connection or a vulcanized region 44.

In the embodiment shown in FIG. 1, the materially engaging connection 38 is constructed between an offset end face 46 and a guiding sleeve end face 48 which are arranged adjacent to the pressure chamber 22 in the housing 12.

In some embodiments, the materially engaging connection 38 may be resistant against an influence of the fuel 26, that is to say, for example, in the embodiment using adhesive 40, for the adhesive 40 not to be soluble in the fuel 26.

In some embodiments, the materially engaging connection 38, in particular the adhesive 40, may be able to withstand temperature ranges of up to 180° C. and to be thermally stable, that is to say, not to melt in these temperature ranges.

In the embodiment according to FIG. 1, the materially engaging connection 38 is used not only to connect the housing recess 14 and guiding sleeve 18, but at the same time also as a sealing arrangement 50 which prevents a leakage of fuel from the pressure chamber 22 to the chamber 34.

Figure 2:
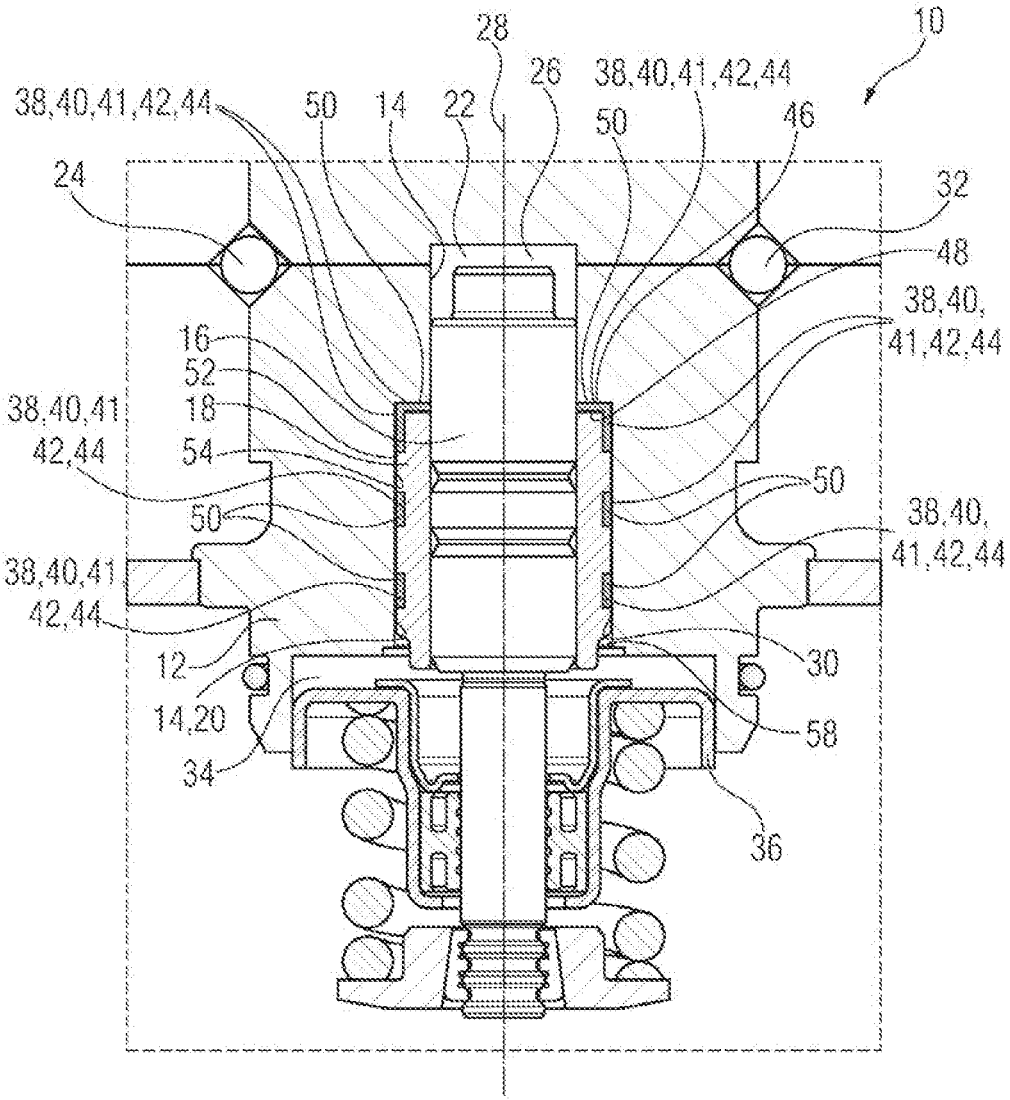
FIG. 2 is a longitudinally sectioned view of a second embodiment of a high-pressure fuel pump with a materially engaging connection between the guiding sleeve and the housing recess.

In some embodiments, such as that shown as the longitudinally sectioned view in FIG. 2, the materially engaging connection 38 is arranged not only on the offset end face 46 or the guiding sleeve end face 48, but also on offset side faces 52 or guiding sleeve side faces 54. It is thereby possible to achieve even better securing of the guiding sleeve 18 in the housing recess 14 and on the whole also a better sealing action of the materially engaging connection 38 which acts as a sealing arrangement 50.

Figure 3:
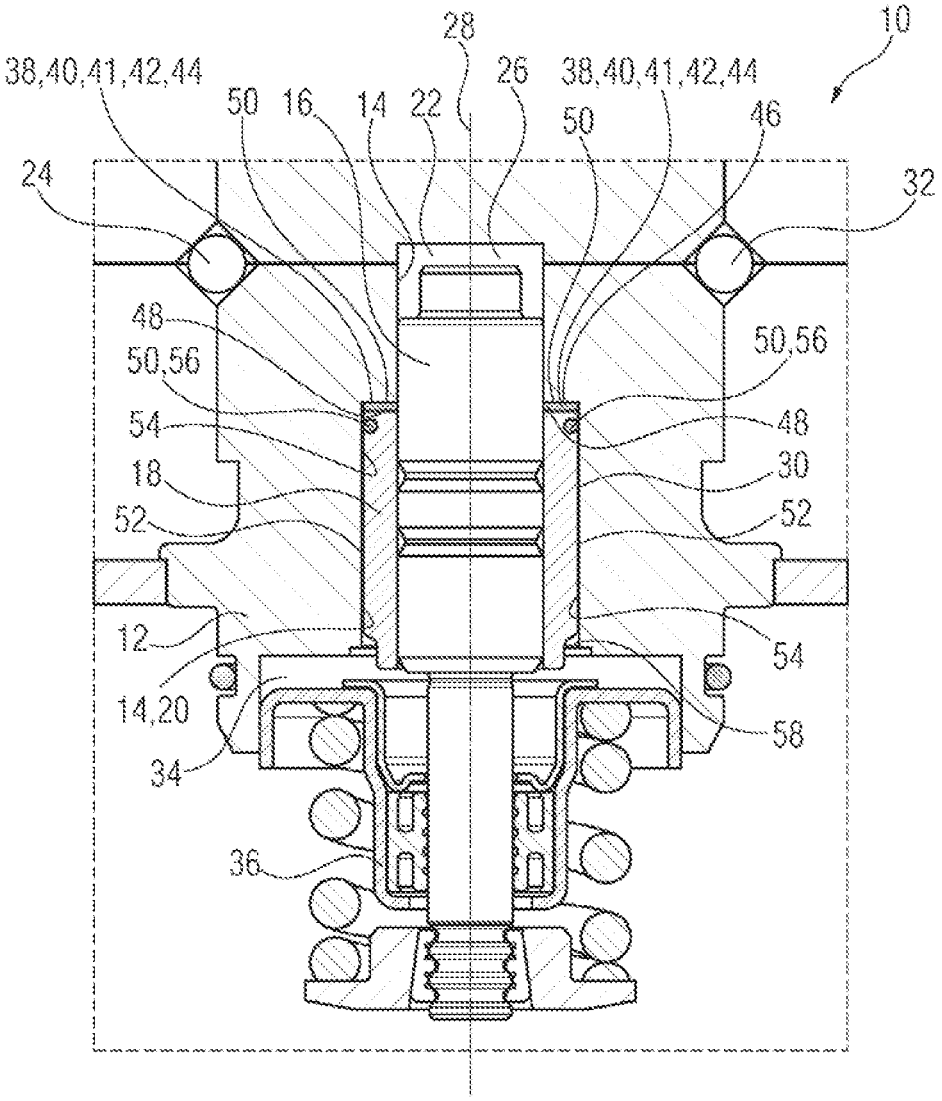
FIG. 3 is a longitudinally sectioned view of a third embodiment of a high-pressure fuel pump with a materially engaging connection between the guiding sleeve and the housing recess, wherein an additional sealing arrangement is provided.

FIG. 3 is a longitudinally sectioned view of an embodiment of the high-pressure fuel pump 10 in which in addition to the materially engaging connection 38 in the region of the offset end face 46 or the guiding sleeve end face 48, a separate sealing arrangement 50, for example, an 0 ring 56, is provided for sealing a joint 58 between the housing recess 14 and the guiding sleeve 18 against a fuel leakage. The high-pressure fuel pump 10 consequently has a first sealing arrangement 50 and a second sealing arrangement 50 of different types.

In contrast to known pumps, the materially engaging connection 38 replaces a positive-locking connection of the components guiding sleeve 18 and housing 12 by means of pressing and caulking and thus prevents the occurrence of tensions via the high assembly forces required, and consequently at the same time deformations in the components.

Secondly, the materially engaging connection 38 acts as a seal against a fuel leakage from the pressure chamber 22 so that, in principle, it would be possible to dispense with additional sealing arrangements 50.

LIST OF REFERENCE NUMERALS

10 High-pressure fuel pump
12 Housing
14 Housing recess
16 Pump piston
18 Guiding sleeve
20 Offset
22 Pressure chamber
24 Valve
26 Fuel
28 Longitudinal axis
30 Guiding gap
32 Valve
34 Chamber
36 Tappet
38 Materially engaging connection
40 Adhesive
41 Adhesive connection
42 Weld connection
44 Vulcanized region
46 Offset end face
48 Guiding sleeve end face
50 Sealing arrangement
52 Offset side face
54 Guiding sleeve side face
56 O ring
58 Joint

What is claimed is:

1. A high-pressure fuel pump comprising:
a housing having a housing recess;
a pump piston for pressurizing a fuel; and
a guiding sleeve arranged in the housing recess and guiding the pump piston;
wherein the guiding sleeve is connected to the housing recess with a materially engaging connection;
the materially engaging connection comprises an adhesive;
the guiding sleeve is arranged in an offset of the housing recess extending adjacent to a pressure chamber of the high-pressure fuel pump as far as a chamber at an end of the pump piston opposite the pressure chamber;
the offset includes an offset end face on which a guiding sleeve end face of the guiding sleeve is arranged; and
the adhesive is disposed between the offset end face and the guiding sleeve end face.

2. The high-pressure fuel pump as claimed in claim 1, wherein the adhesive is thermally stable up to a temperature of at least 180° C.

3. The high-pressure fuel pump as claimed in claim 1, wherein the adhesive is insoluble in fuels.

4. The high-pressure fuel pump as claimed in claim 1, wherein the offset includes an offset side face on which a guiding sleeve side face is arranged; and
wherein the adhesive is disposed between the offset side face and the guiding sleeve side face.

5. A high-pressure fuel pump comprising:
a housing having a housing recess;
a pump piston for pressurizing a fuel; and
a guiding sleeve arranged in the housing recess and guiding the pump piston;
wherein the guiding sleeve is connected to the housing recess with a materially engaging connection; and
the materially engaging connection includes a region in which the guiding sleeve is vulcanized to the housing recess.

6. The high-pressure fuel pump as claimed in claim 1, further comprising a seal disposed between the housing recess and the guiding sleeve.

* * * * *